US009321152B2

(12) United States Patent
Heinsohn et al.

(10) Patent No.: US 9,321,152 B2
(45) Date of Patent: Apr. 26, 2016

(54) PLIERS

(75) Inventors: Andreas Heinsohn, Wuppertal (DE); Bernd Riepe, Wuppertal (DE)

(73) Assignee: KNIPEX-Werk C. Gustav Putsch KG, Wuppertal (DE)

( * ) Notice: Subject to any disclaimer, the term of this patent is extended or adjusted under 35 U.S.C. 154(b) by 240 days.

(21) Appl. No.: 14/236,235

(22) PCT Filed: Aug. 4, 2011

(86) PCT No.: PCT/EP2011/063428
§ 371 (c)(1),
(2), (4) Date: Jan. 30, 2014

(87) PCT Pub. No.: WO2013/017174
PCT Pub. Date: Feb. 7, 2013

(65) Prior Publication Data

US 2014/0157960 A1 Jun. 12, 2014

(51) Int. Cl.
*B25B 7/08* (2006.01)
*B26B 17/00* (2006.01)

(52) U.S. Cl.
CPC .. *B25B 7/08* (2013.01); *B26B 17/00* (2013.01)

(58) Field of Classification Search
CPC ..... B25B 7/08; B26B 13/26; B26B 17/00; B23D 29/26; B23D 29/026
See application file for complete search history.

(56) References Cited

U.S. PATENT DOCUMENTS 213,758 A * 4/1879 Kellar ..... B26B 17/00 30/146
1,346,983 A 7/1920 Shaffer
1,729,695 A 10/1929 Adams
3,017,692 A * 1/1962 Floyd ..... B25B 27/205 29/229
4,099,315 A * 7/1978 Pudenz ..... A61B 17/2816 29/434
4,414,868 A * 11/1983 Puro ..... B25B 7/08 30/193

(Continued)

FOREIGN PATENT DOCUMENTS

CN 2601782 Y 2/2004
CN 101495273 A 7/2009

(Continued)

OTHER PUBLICATIONS

International Search Report of PCT/EP2011/063428, mailed May 7, 2012.

*Primary Examiner* — David B Thomas
(74) *Attorney, Agent, or Firm* — Collard & Roe, P.C.

(57) ABSTRACT

The invention relates to A pliers (1) having two pliers limbs (2, 3) which are connected so as to be pivotable relative to one another in a box joint having a joint pin (4), a working region (7, 8) being formed on one pliers limb (2, 3) on the one side of the joint and a gripping region (9, 10) being formed on the other side of the joint, and a passed-through pliers limb (3) being formed with a push-through slot (11) which has a slot width (s) in the joint region and through which the other through-passing pliers limb (2) extends, the working regions of the pliers limbs (2, 3) moreover having, at least in part, a width (b) that is greater than the slot width (s), and the working regions (7, 8) designed in the form of jaws or cutting edges pivoting toward a shared central plane (E). In order to improve the pliers with regard to high performance while optimizing manufacturability, it is proposed that the joint pin (4) be laterally offset with respect to the central plane (E).

9 Claims, 4 Drawing Sheets

(56) References Cited

U.S. PATENT DOCUMENTS

| | | | | |
|---|---|---|---|---|
| 8,087,327 | B2 | 1/2012 | Lorbach | |
| 8,327,548 | B2 * | 12/2012 | Ronan | B26B 17/00 30/175 |
| 8,695,464 | B2 | 4/2014 | Herrmann | |
| 2006/0207101 | A1 * | 9/2006 | Scarla | B26B 17/00 30/145 |
| 2007/0204470 | A1 * | 9/2007 | Lai | B26B 3/167 30/244 |
| 2009/0038165 | A1 * | 2/2009 | Lai | B26B 17/00 30/287 |
| 2009/0165602 | A1 * | 7/2009 | Lorbach | B25B 7/08 81/416 |
| 2013/0047441 | A1 * | 2/2013 | Schultes | B25B 7/00 30/259 |

FOREIGN PATENT DOCUMENTS

| | | | |
|---|---|---|---|
| CN | 101568408 | A | 10/2009 |
| CN | 101637890 | A | 2/2010 |
| DE | 10 2004 022943 | A1 | 12/2005 |
| DE | 10 2006 024296 | A1 | 11/2007 |
| DE | 10 2007 049 032 | A1 | 4/2008 |
| EP | 2 149 427 | A1 | 2/2010 |
| TW | 312193 | U | 8/1997 |

* cited by examiner

PLIERS

CROSS REFERENCE TO RELATED APPLICATIONS

This application is the National Stage of PCT/EP2011/063428 filed on Aug. 4, 2011, the disclosure of which is incorporated by reference. The international application under PCT article 21(2) was not published in English.

BACKGROUND OF THE INVENTION

1. Field of the Invention

The invention relates to a pliers having two pliers limbs which are connected so as to be pivotable relative to one another in a box joint having a joint pin, a working region being formed on one pliers limb on the one side of the joint and a gripping region being formed on the other side, a passed-through pliers limb being formed with a push-through slot, which has a slot width in the joint region and through which the other through-passing pliers limb extends, the working regions of the pliers limbs moreover having, at least in part, a width that is greater than the slot width, and the working regions in the form of jaws or cutting edges pivoting toward a central plane situated in the middle of the pivot region.

2. Description of the Related Art

Pliers of this kind are already known. Reference is made, for example, to DE 10 2006 024 296 A1. The known pliers is formed as a side cutter. It may also be for example a center cutter or a combination pliers.

In the case of a pliers known from U.S. Pat. No. 1,346,983, the articulation point of the passed-through pliers limb is very distant from the central plane. The pliers is designed only as gripping pliers. A pliers is known from DE 10 2004 022 943 A1, the pliers limbs of which lie on top of one another. For adjustment, an adjusting member is provided which is hinged to one pliers limb and which is displaceable in steps in the first pliers limb. A pliers is known from U.S. Pat. No. 1,729,695 A, in which only one of the pliers limbs forms a gripping region and a working region. This pliers limb encloses another pliers limb that has no gripping region.

SUMMARY OF THE INVENTION

The aim is to improve the pliers with regard to high performance while optimizing manufacturability.

Such a pliers is provided by the subject matter in accordance with the invention, in which it is provided that the joint pin is offset relative to the central plane by an offset dimension that corresponds to one-half the radius up to twice the diameter of the joint pin. A slot depth provided perpendicular to the slot width is provided in the joint region in a size such that a significant offset of the joint pin out of the central plane is made possible. As an alternative, in principle it is also possible that the push-through slot extends in a curved manner, thus practically without broadening in the joint region, in such a way that the slot depth essentially does not change. However, such a configuration is not necessarily conducive to a desired high stability. Due to the fact that the joint pin is offset from the center, the push-through slot can be designed in a more favorable manner. In particular, no special machining of the end region of the push-through slot on the jaw side is required in the region of the joint pin. Moreover, the receiving region for the joint pin, since it is offset to one side with respect to an extent of the push-through slot, is advantageously accessible from this side for machining. In particular, a broad cut-through of the push-through slot can be carried out in the region of the joint pin, parallel to the central plane. For example, a milling tool that is used for this purpose can thus be continuously moved in this region.

It is preferred that a geometric axis of the joint pin, with respect to a perpendicular to the central plane in the direction of this perpendicular, i.e., in a projection of the joint pin in the direction of the perpendicular onto the region of the passed-through pliers limb that is formed to one side of the joint pin, is arranged in alignment with a non-slotted region of the passed-through pliers limb. In the region of the joint pin, the passed-through pliers limb, perpendicular to the joint pin, is not cut through in full alignment with the joint pin. The stability is advantageously influenced. In the region of the joint pin, the push-through slot is formed, at least partially, in a position adjacent to a region of this pliers limb which is not cut through.

It is also preferred that the push-through slot of the passed-through pliers limb has an edge line on the jaw side, the edge line, in a view extending from the central plane, extending downwardly toward a free end of this pliers limb. If visualized in this regard from a conventional curved run of the pliers limb, the end region of the push-through slot, formed by a wall of the pliers limb region that is not cut through on the jaw side, does not extend perpendicularly with respect to the central plane or the longitudinal extent, but, rather, extends at an angle. Thus, in part, namely facing toward the central plane, the push-through slot in this pliers limb is formed more broadly in the working region side than in a region that is farther away from the central plane.

It is also preferred that the peripheral edge of the push-through slot on the jaw side extends in a curved manner in the mentioned longitudinal section. It is in particular preferred that the peripheral edge, viewed from the central plane, extends in a concave manner.

Furthermore, it is also preferred that in the mentioned longitudinal cross-section, the peripheral edge of the push-through slot associated with the free end of the passed-through pliers limb extends upwardly toward the central plane when the pliers is closed. The extent of the peripheral edge that is associated with the free end region of the pliers limb is thus, as it were, in any case with respect to the principal extent, a mirror image of the extent of the peripheral edge in the working region end of the push-through slot.

The peripheral edge of the push-through slot that is associated with the free end preferably also extends in a curved manner, and moreover preferably extends in a concave manner as viewed from the central plane.

Another preferred configuration provides that the delimitation of the push-through slot of the passed-through pliers limb on the working region side forms a limit stop for the through-passing pliers limb in the open position of the pliers. Via the configuration of the end region, the opening characteristic of the pliers can be adjusted in a simple manner. Moreover, this limit stop is not directly accessible. There is practically no danger of pinching.

Not least, it is preferred that the slot depth, with regard to a perpendicular to the central plane in the closed state of the pliers, is smaller on a line of the geometric axis of the joint pin than in a region that is connected thereto and is offset toward the free end of the pliers limb. The slot depth on a line of the geometrical axis of the joint pin, measured in the manner as indicated, is more than two times, preferably more than three times, the diameter of the joint pin. An upper limit may be, for example, five times the diameter of the joint pin. In the broadened region offset toward the free end of the pliers limb, the mentioned dimension broadens again in a range of from ¼ up to double the radius of the joint pin. A longitudinal extent of this broadened region of the push-through slot, measured in the direction of the central plane starting from a perpendicular to the central plane that extends through the geometric axis of the joint pin, within which region there is also a broadening of the breadth of the push-through slot, here preferably corresponds to one-third to twice the radius of the joint pin.

The joint pin, which is preferably formed as a regular cylinder, in any case in a middle region, can have a diameter that ranges from 3 to 9 mm, for example.

The gripping regions of the pliers limbs may also be accommodated in each case in a handle cover. Handle covers that are considered to be suitable are in particular handle covers that are produced using the plastics injection molding method. The handle covers are in particular configured in such a manner that with regard to both pliers limbs, they provide the same thickness to the hand enclosing them. With respect to the gripping region having the smaller dimension, thus in particular the gripping region of the pliers limb that passes through, a handle cover is thus preferably formed with material reinforcement. Material reinforcement can in a first instance be provided in the sense of a greater material thickness. Moreover, it can alternatively or additionally be provided in the sense of a reinforcement element that is incorporated into the handle cover. In further detail with regard to the handle covers, reference is also made to the above-cited DE 10 2006 024 296 A1, the disclosure content of which is hereby included in full in the present application, including for the purpose of incorporating features of the cited application in claims of the present application.

With regard to the gripping region of the through-passing pliers limb, in the present context it is also preferred that the pliers limb has a width, and optionally a thickness, that corresponds at a maximum to the slot width. However, it can also be provided that the width is slightly greater, in any case to an extent such that inserting the through-passing pliers limb into the passed-through pliers limb can still be carried out without a complex heating process, and instead can be carried out merely by means of cold forming, which can also include cold plastic deformation.

In absolute terms, the width of the pliers limb may be approximately 2 to 3 mm larger than the slot width.

With regard to the disclosure, the ranges or value ranges specified above and below also include all intermediate values, in particular in 1/10 increments of the respective dimension, thus for example 1/10 mm, on the one hand for delimiting the mentioned range boundaries from below and/or above, alternatively or additionally, however, also with regard to the disclosure of one or more single values from the respective range. This also relates to range boundaries that are given without dimensions, numerical values as such, whether as a delimitation and/or as single numerical values, in this respect being included in the disclosure.

BRIEF DESCRIPTION OF THE DRAWINGS

The invention is further explained below with reference to the accompanying drawings. In the figures.

DETAILED DESCRIPTION OF PREFERRED EMBODIMENTS

Figure 1:
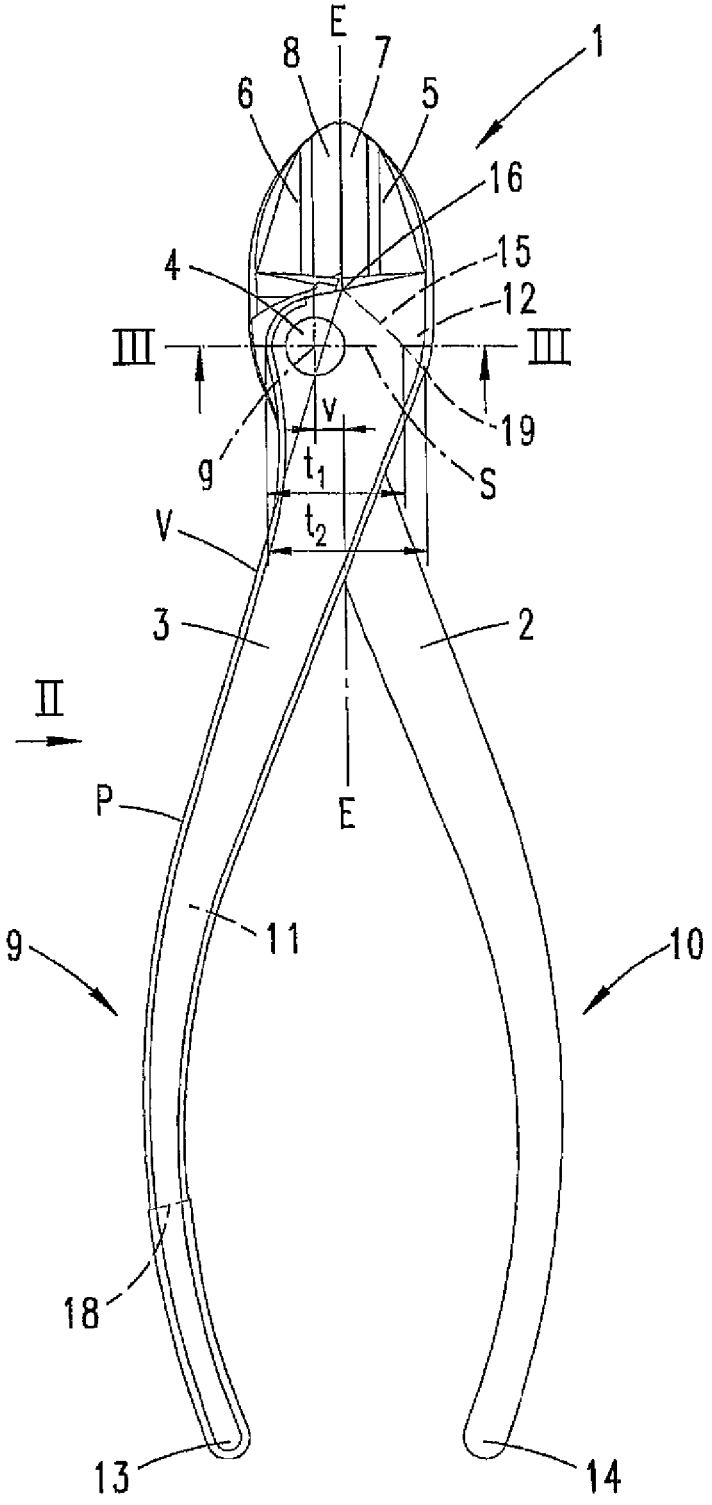
FIG. 1 shows a plan view of the pliers.

Illustrated and described is a pliers 1 having two pliers limbs 2, 3 that are connected so as to be pivotable relative to one another in a box joint having an axially fixed joint pin 4. On the one side of the joint pin 4, the pliers limbs 2, 3 form pliers jaws 5, 6 which, in the exemplary embodiment, have working regions 7, 8 in the form of cutting edges. Gripping regions 9, 10 are formed on the other side of the joint pin 4.

In the exemplary embodiment, the joint pin 4 illustrated is formed with a thin flat head on the one side and a (small) countersunk head on the other side. Such a countersunk head can also be formed on both sides. In the exemplary embodiment, the joint pin 4 has a diameter of 5 mm in its cylindrical region. In principle, diameters of 3 to 6 mm, for example, can be implemented in this respect.

Figure 2:
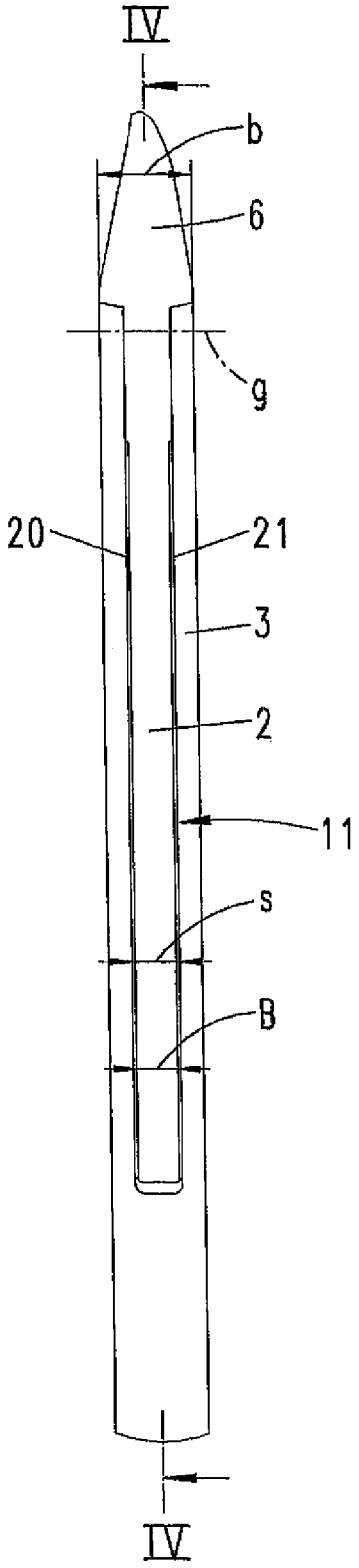
FIG. 2 shows a side view of the pliers.

One of the pliers limbs, the pliers limb 3 in the exemplary embodiment, is provided with a push-through slot 11 through which the other pliers limb 2 is pushed through. The pliers jaws 5, 6 have, at least in parts, a width b that is greater than the slot width s (cf. FIG. 2, for example).

Figure 6:
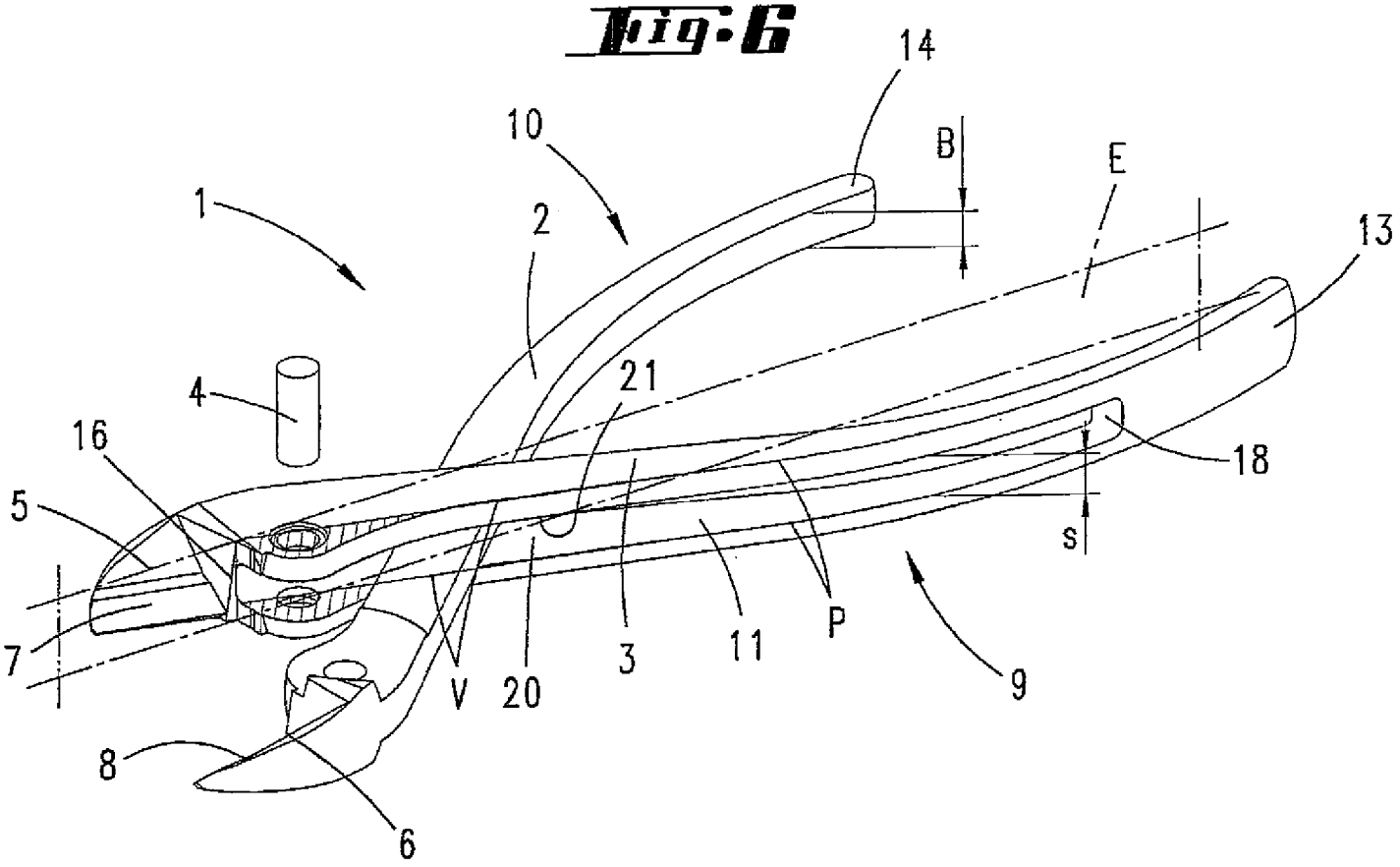
FIG. 6 shows an illustration of the pliers according to FIG. 1 and FIG. 2 in an exploded view.

Moreover, the gripping region 10 of the through-passing pliers limb 2 has a width B (dimension in the direction of the geometric axis of the joint pin 4), see FIG. 6, for example, that corresponds at a maximum, and in the exemplary embodiment corresponds precisely, to the slot width s (on the other hand, as discussed earlier, a greater width B could also be implemented here).

The push-through slot 11 is provided between slot walls 20, 21 that extend parallel to one another.

The pliers jaws 5, 6 or working regions 7, 8, specifically, the cutting tips of the working regions in the exemplary embodiment, are to be pivoted toward a shared central plane E. It is preferred that in this central plane E, the cutting tips lie against one another when the pliers is closed (see FIGS. 1, 4).

In the plan view according to FIG. 1 in which the central plane E is indicated as a line, the joint pin 4 is laterally offset with respect to the central plane E. In the exemplary embodiment, the dimension v of the offset, in relation to the geometric center axis g of the joint pin 4, corresponds to the dimension of the radius of the joint pin 4 that is formed as a cylinder body.

Figure 4:
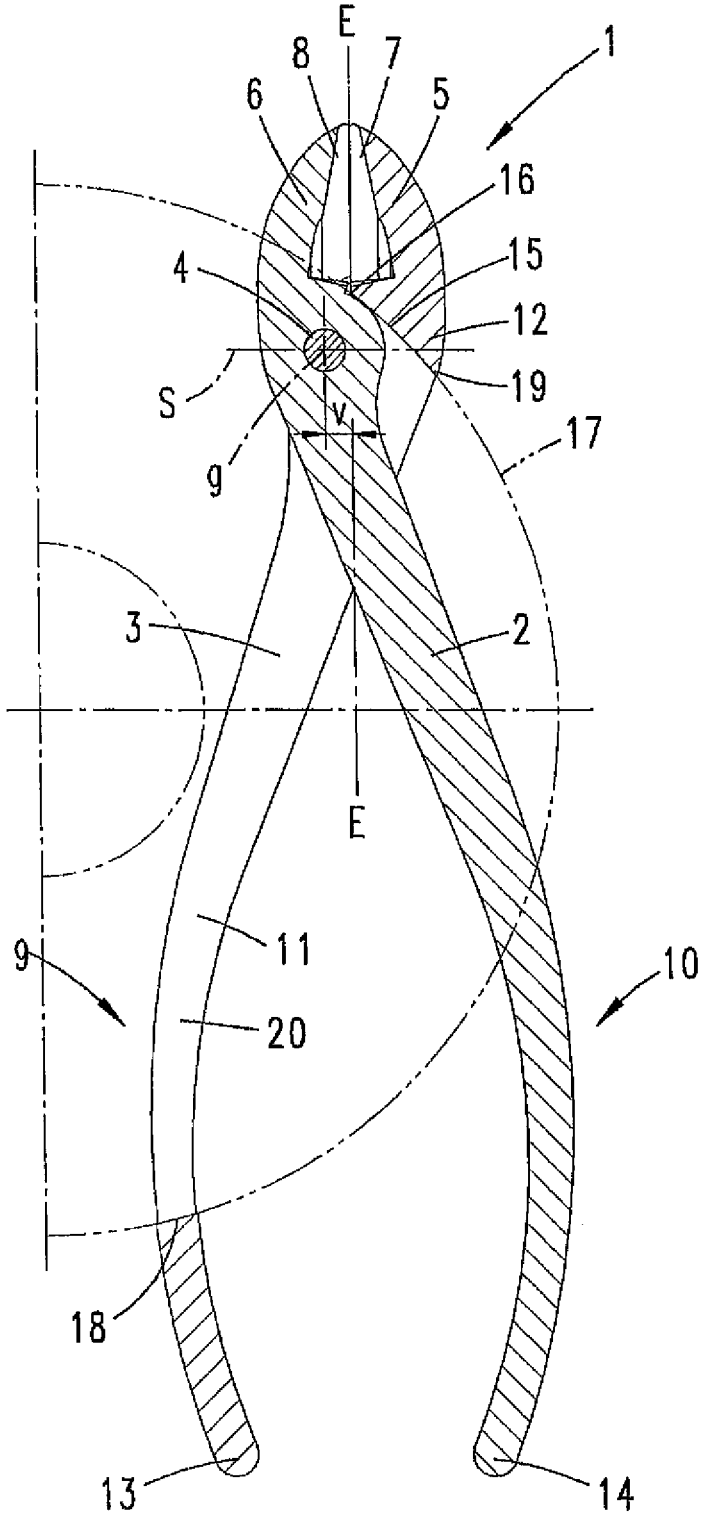
FIG. 4 shows a longitudinal section through the pliers according to FIG. 1 and FIG. 2, sectioned along the line IV-IV in FIG. 2.
Figure 3:
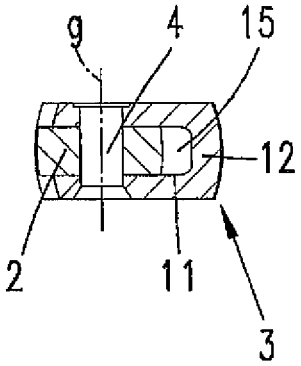
FIG. 3 shows a cross-section through the pliers according to FIG. 1, sectioned along the line III-III.

As is apparent in particular from FIGS. 3 and 4, the geometric axis g of the joint pin 4 on a perpendicular S to the central plane E is aligned with a non-slotted region 12 on the jaw side of the passed-through pliers limb 3. With respect to the perpendicular S, the region 12 extends below the perpendicular S, with respect to the illustration in FIG. 4, toward a free end 13 or 14, respectively, of the pliers limbs, in a spandrel-like manner or in the form of a triangle. It is apparent that the outer edges of the triangle are formed to extend in a curved manner. This is also illustrated by the sectional view according to FIG. 3.

With respect to the central plane E, a peripheral edge 15 of the end region of the push-through slot 11 converges with this central plane approximately at a point 16 or at a region which has a smaller wall thickness and which is associated with the ends of the cutting edges on the joint side. The point 16 is located above the joint pin 4. Viewed from the start on the central plane E, the peripheral edge in the illustration according to FIG. 4 extends downwardly from the point 16 toward the free ends 13 and 14 of the pliers limbs. Moreover, as viewed from the central plane E, the peripheral edge 15 is also formed to extend in a concavely curved manner.

Furthermore, in the exemplary embodiment, the peripheral edge 15 is situated on a shared circular line 17 with respect to the end of the peripheral edge 18 of the push-through slot 11 facing the free end 13 of the pliers limb 3.

A radius of the circular line 17 corresponds to a multiple of the width s of the push-through slot 11. In the exemplary embodiment, the radius corresponds to approximately 13 times the width s. It is preferred that the radius corresponds to a range of from 5 to 20 times the clearance s of the push-through slot.

Accordingly, the peripheral edge 18 likewise extends in a curved manner; as viewed from the joint pin 4, the peripheral edge extends in a concave manner.

Figure 5:
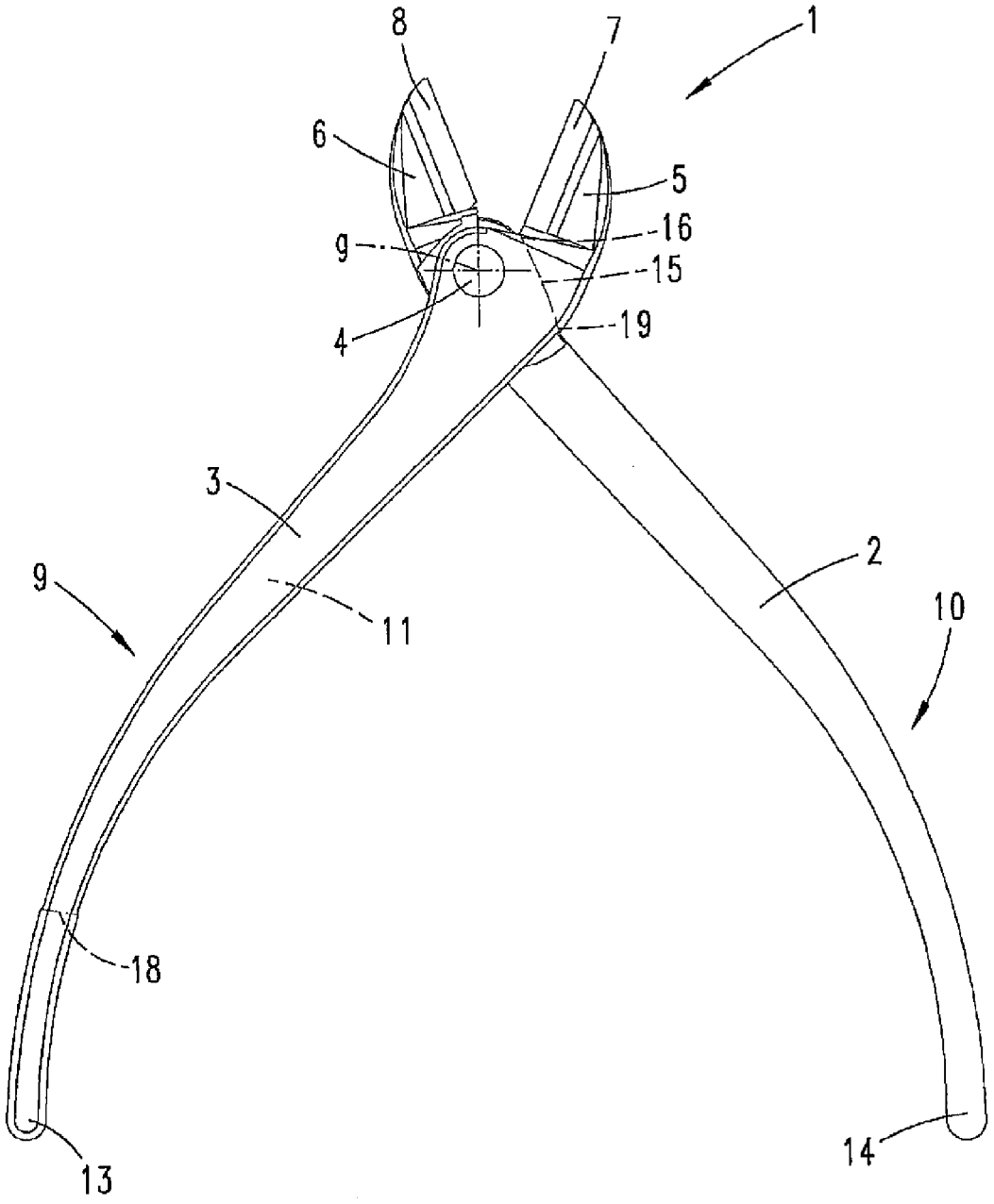
FIG. 5 shows an illustration of the pliers according to FIG. 1 in the open position.

As is apparent in particular from FIG. 5, the peripheral edge 15, here the tip 19 thereof at the outer edge, represents a limit stop for the through-passing pliers limb 2 in the open position.

A slot depth $t_1$, measured on the perpendicular S, is less than a slot depth $t_2$ in an adjoining region that is offset toward the free end 13 of the passed-though pliers limb 3. $t_2$ is greater than $t_1$ by approximately 15%.

As is apparent, for instance, from FIG. 6, the regions, shown here in crosshatch, of the two slot walls 20, 21 of the passed-through pliers limb 3 in a manner of speaking freely overlap the pliers jaw 6, as viewed from the pliers jaw 5. The jaw material that connects the slot walls 20, 21 at the base of the cutting edge of the pliers jaw 5 (see also point 16) ends approximately in the region of the central plane. The cross-hatched regions of the slot walls 20, 21 protrude therefrom in a balcony-like manner. The protrusion arises with regard to a connecting line V between the point 16 and a vertex P of the outer curvature contour of the passed-through pliers limb 3 in the gripping region thereof. The holes for the joint pin 4, which are formed in alignment with one another in the slot walls 20, 21, extend at least partially, preferably with more than half of their hole area, more preferably with up to their entire hole area, within the mentioned protruding regions.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive refinement of the prior art, in particular to undertake divisional applications based on these claims.

LIST OF REFERENCE NUMERALS/CHARACTERS

1 Pliers
2 Pliers limb
3 Pliers limb
4 Joint pin
5 Pliers jaw
6 Pliers jaw
7 Working region
8 Working region
9 Gripping region
10 Gripping region
11 Push-through slot
12 Region
13 Free end
14 Free end
15 Peripheral edge
16 Point
17 Circular line
18 Peripheral edge
19 Tip
20 Slot wall
21 Slot wall
b Width
g Center axis
S Slot width
v Offset dimension
$t_1$ Slot depth
$t_2$ Slot depth
B Width
E Central plane
P Vertex
V Connecting line
S Perpendicular

The invention claimed is:

1. A pliers (1) having two pliers limbs (2, 3) which are connected so as to be pivotable relative to one another in a box joint having a joint pin (4), a working region (7, 8) being formed on one pliers limb (2, 3) on the one side of the joint and a gripping region (9, 10) being formed on the other side of the joint, and a passed-through pliers limb (3) being formed with a push-through slot (11) which has a slot width (s) in the joint region and through which the other through-passing pliers limb (2) extends, the working regions of the pliers limbs (2, 3) moreover having, at least in part, a width (b) that is greater than the slot width (s), and the working regions (7, 8) designed in the form of jaws or cutting edges pivoting toward a shared central plane (E), wherein the joint pin (4) is offset with respect to the central plane (E) by an offset dimension that corresponds to one-half the radius up to twice the diameter of the joint pin, and wherein a geometrical axis (g) of the joint pin (4), with respect to a perpendicular (S) to the central plane (E), is aligned with a non-slotted region (12) of the passed-through pliers limb (3).

2. The pliers according to claim 1, wherein the passed-through pliers limb (3) has a peripheral edge (15) on the working region side, the peripheral edge extending from an intersection point (16) with the central plane (E) and extending downwardly toward a free end (13) of the pliers limb (3).

3. The pliers according to claim 2, wherein the peripheral edge (15) extends in a curved manner.

4. The pliers according to claim 2, wherein the peripheral edge (15), as viewed from the central plane (E), extends in a concave manner.

5. The pliers according to claim 1, wherein in the longitudinal cross-section, the peripheral edge (18) of the push-through slot (11) associated with the free end region (13) of the passed-through pliers limb (3) extends upwardly toward the center line when the pliers (1) is closed.

6. The pliers according to claim 1, wherein the peripheral edge (18) of the push-through slot (11) associated with the free end region (13), as viewed from the joint pin (4), extends in a concave manner.

7. The pliers according to claim 1, wherein the slot delimitation of the passed-through pliers limb on the working region side forms a limit stop for the through-passing pliers limb (2) in the open position of the pliers (1).

8. The pliers according to claim 1, wherein the gripping region (10) of the through-passing pliers limb (2) has a width (B), and optionally a thickness, which are adapted to the slot width (s) and which correspond, for example, at a maximum to the slot width (s), or have a slight oversize.

9. A pliers (1) having two pliers limbs (2, 3) which are connected so as to be pivotable relative to one another in a box joint having a joint pin (4), a working region (7, 8) being formed on one pliers limb (2, 3) on the one side of the joint and a gripping region (9, 10) being formed on the other side of the joint, and a passed-through pliers limb (3) being formed with a push-through slot (11) which has a slot width (s) in the joint region and through which the other through-passing pliers limb (2) extends, the working regions of the pliers limbs (2, 3) moreover having, at least in part, a width (b) that is greater than the slot width (s), and the working regions (7, 8) designed in the form of jaws or cutting edges pivoting toward a shared central plane (E), wherein the joint pin (4) is offset with respect to the central plane (E) by an offset dimension that corresponds to one-half the radius up to twice the diameter of the joint pin, wherein further the joint pin goes through holes in protrusions of the push-through slot, the protrusions protrude in a balcony-like manner with regard to a connection line (V) between a point (16) and a vertex (P) of the outer curvature contour of the passed-through pliers limb, the point (16) being defined by a crossing between the central plane (E) with a region of smaller wall thickness of the cutting edges at the ends of the cutting edges on the joint side.

* * * * *